United States Patent [19]

Simpson

[11] 4,378,053

[45] Mar. 29, 1983

[54] TOOL HOLDER

[75] Inventor: Frank F. Simpson, Staines, England

[73] Assignee: Black & Decker Inc., Newark, Del.

[21] Appl. No.: 208,512

[22] Filed: Nov. 20, 1980

[30] Foreign Application Priority Data

Nov. 30, 1979 [GB] United Kingdom ..... 7941494

[51] Int. Cl.[3] ..... B25D 16/00

[52] U.S. Cl. ..... 173/13; 173/109; 279/80; 279/82

[58] Field of Search ..... 173/13, 47, 48, 104, 173/109, 116, 117, 118; 279/1 B, 76, 79, 80, 82; 74/22 R, 22 A

[56] References Cited

U.S. PATENT DOCUMENTS

| | | | |
|---|---|---|---|
| 2,318,172 | 5/1943 | Long | 279/82 X |
| 2,320,360 | 6/1943 | Grey | 279/79 |
| 2,680,636 | 6/1954 | Griffin | 279/76 X |
| 3,511,321 | 5/1970 | Schnettler | 173/109 X |
| 3,536,335 | 10/1970 | Schmuck | 279/81 |
| 3,583,715 | 6/1971 | Jahrl | 279/82 X |
| 3,693,728 | 9/1972 | Stroezel | 173/48 X |
| 3,921,729 | 11/1975 | Schmuck | 173/116 X |
| 4,107,949 | 8/1978 | Wanner et al. | 279/1 B X |
| 4,202,557 | 5/1980 | Haussmann et al. | 279/82 X |

FOREIGN PATENT DOCUMENTS

| | | |
|---|---|---|
| 2834991 | 10/1978 | Fed. Rep. of Germany . |
| 2806611 | 8/1979 | Fed. Rep. of Germany . |
| 896189 | 5/1962 | United Kingdom . |

*Primary Examiner*—Stephen G. Kunin
*Assistant Examiner*—Robert P. Olszewski
*Attorney, Agent, or Firm*—Walter Ottesen; Ronald Sherer; Edward D. Murphy

[57] ABSTRACT

A tool holder has a rotatable drive sleeve adapted to receive therein a tool and having a pair of diametrically opposed slots disposed axially along part of its length. A key extends inwardly into each slot and is movable through its sot for retaining and rotatably driving the tool. The slots have an axial length greater than that of the keys which are slidable axially there along. A locking collar, having an internal surface diverging progressively outwardly over at least a portion of its length in the axial direction, encircles the sleeve and is movable axially in one direction for locking the keys in engagement with the tool, and in the opposite direction to allow disengagement of the tool. The action of the divergent surface portion on the keys enables the keys to be locked in position over a range of inward penetrations to accommodate tools having driving recesses of different depths. A stop member is rotatable on the sleeve between two positions, which cause the slots to have a shorter or longer effective length, respectively, to change the tool holder from rotary only mode to hammer mode. A coil spring urges the locking collar away from the stop member. A circumferential spring may be incorporated to urge the keys radially inwards, inward motion being limited by shoulders on the keys.

14 Claims, 12 Drawing Figures

TOOL HOLDER

FIELD OF THE INVENTION

The present invention relates generally to tool holders and more particularly to improved tool holders for portable tools such as portable drills, hammer drills, rotary hammers and the like and to adaptors for such portable tools.

BACKGROUND OF THE INVENTION

A tool holder must be able to prevent inadvertent withdrawal of the tool or bit from the holder and must also transmit, when desired, rotary motion to the tool or bit. In some applications, particularly those suitable for rotary hammers, the holder must permit the disengagement of the hammer or percussive action so that the tool or bit undergoes rotary movement only.

Problems associated with the retention and drive of the tool or bit have produced a number of proposed solutions.

In one such solution one set of members in the form of balls is used to retain the tool or bit and another set in the form of ridges is used to drive the latter. This necessitates the tool or bit having a shank with recesses to receive the separate sets of members.

In another such solution one set of cylindrically shaped members is used to retain and drive the tool or bit, and requires the tool or bit to have a shank of a configuration somewhat different from that required by the first solution referred to above.

Another arrangement described in British Pat. No. 896,189 has a single key like member to retain and drive the tool. However, there is no indication that this arrangement could accommodate tools with shanks of different configurations.

Due to the different requirements of many of the tool holders at present available, each is normally designed to accept a tool of one form only. An adaptor is required when a tool of another form is to be used.

It is therefore an object of this invention to provide a tool holder capable of more readily receiving tools with shanks of different configurations.

It is another object of this invention to provide for a rotary hammer a tool holder which automatically disengages the tool from percussive action of the rotary hammer when the tool is lifted from the work surface.

It is yet another object of this invention to provide a rotary hammer with an improved tool holder incorporating mode changing from hammer mode to rotary only mode.

SUMMARY OF THE INVENTION

Towards the accomplishment of the aforementioned objects and others which will become apparent from the following description and accompanying drawings, there is disclosed a tool holder comprising a rotatable drive sleeve adapted to receive therein a tool and having a closed-ended slot disposed axially along part of its length. A member having longitudinal side surfaces extending axially of the sleeve and extending inwardly into said slot, the member being movable through the slot for retaining and rotatably driving a tool when present. Locking means, for example a collar, encircling the sleeve is movable axially in one direction for locking the member in engagement with the tool when present, and movable axially in the opposite direction to a position to allow disengagement of the tool.

The collar has an internal surface which diverges outwardly over at least a portion of its length in the axial direction. A spring biases the collar in an axial direction for engagement of said internal surface with the member.

The member is preferably in the form of a key with a blade portion engaging the slot and having a length in the axial direction of the sleeve less than that of the slot and being slidable axially along the slot. In this case, a stop member may be mounted upon the sleeve in a manner that enables the position of the stop member relative to the sleeve to be adjusted to vary the effective lengths over which the member is movable.

In one embodiment, resilient means bias the member inwardly. Such means can be a spring that is circular or part circular in form and encircles the shaft. An aperture in the spring helps locate the member.

In another embodiment the tool holder is combined with a rotary hammer having a beat piece which is reciprocally movable in the sleeve.

DESCRIPTION OF SPECIFIC EMBODIMENTS

Figure 1:
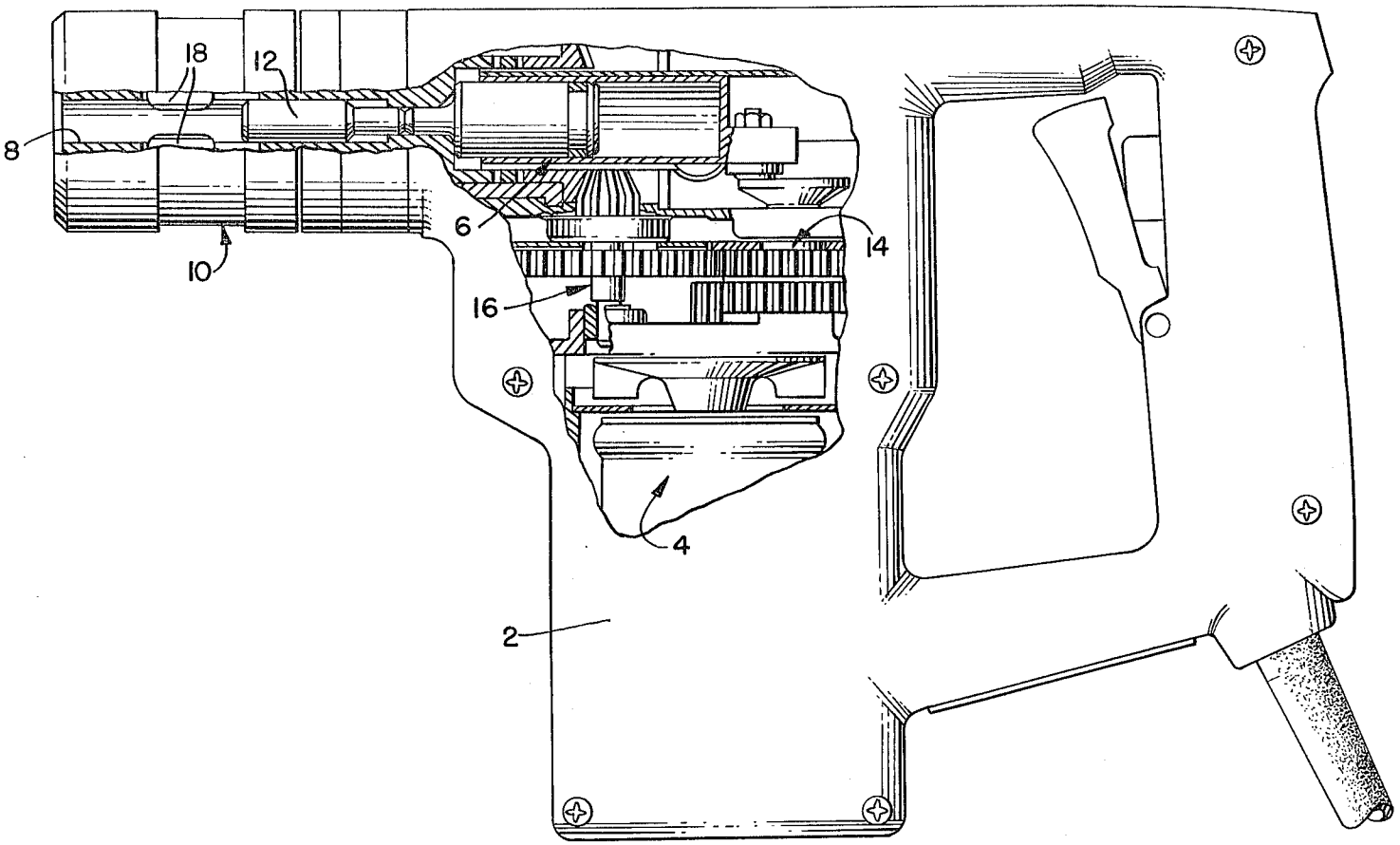
FIG. 1 is a diagramatic elevation view, partly fragmented, of a rotary hammer employing the present invention.

FIG. 1 depicts a rotary hammer having a casing 2 housing an electric motor 4 and a reciprocating hammer mechanism 6. A rotatable drive sleeve 8 extends forwards from the hammer mechanism and forms part of a tool holder 10. A beat piece 12, reciprocable in the tube 8, is acted upon by the hammer mechanism 6 to impart percussive action to a tool when inserted in the sleeve 8, as will be described more fully later. The motor 4 drives the hammer mechanism through a transmission system 14, and rotates the sleeve 8 through a transmission system 16 in known manner. Retractable blade portions 18 of keys for retaining and rotating a tool when present are seen in an inward position and will be described more fully later.

Figure 2:
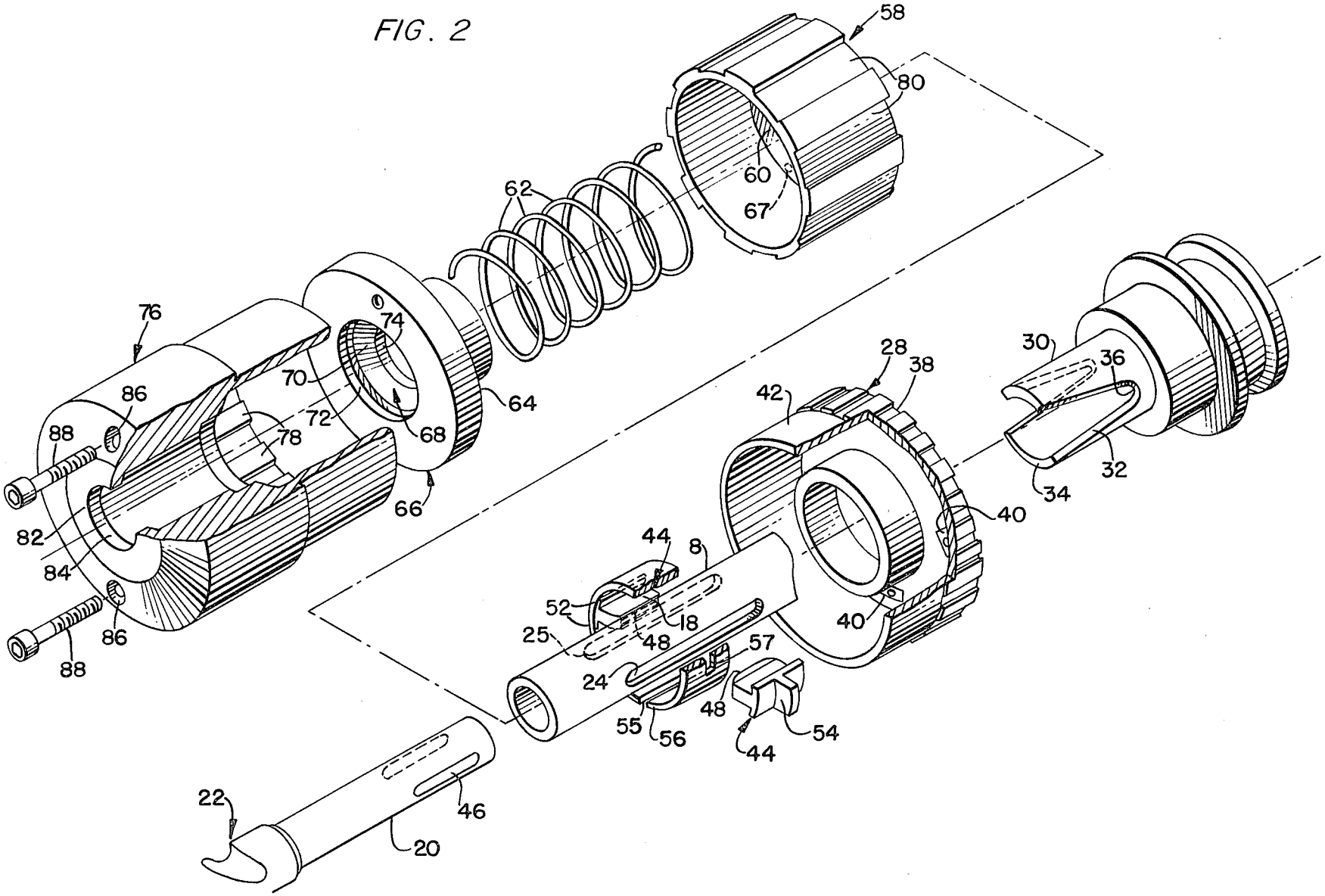
FIG. 2 is an exploded perspective view of a tool holder employing the present invention.

FIG. 2 depicts a first embodiment of the tool holder 10. The drive sleeve is adapted to receive the shank 20 of a tool bit 22 part only of which is shown in the drawing. The sleeve 8 has two diametrically-opposed axial slots 24, 25 in its cylindrically curved wall.

At one end, the drive sleeve 8 extends through a mode change mechanism 28 comprising a two-position stop member 30 of generally cylindrical form, the curved wall of the member 30 having diametrically-opposed, somewhat V-shaped slots 32. The slots 32 may be of other than V-shaped form, for example they may be of a sawtooth form or be rectangularly shaped. Between the open ends of the slots, the end faces 34 of the stop member 30 define one stop position, while the inner ends 36 of the slots define the other stop position. At the opposite end to the end face 34, the stop member 30 is firmly secured to a disc-like form 38. One face of the disc is formed with elements 40 comprising one part of a detent mechanism used to "index" the mode change mechanism 28.

Secured firmly to the disc 38 is a selector ring 42 by means of which a user is able to rotate the stop member relative to the sleeve 8 and into a desired "stop" position.

The tool 22 is retained in position in the sleeve 8 and rotated by means of two driving members 44 located externally of the sleeve but which project through the slots 24, 25 and can be brought into driving and retaining engagement with recesses 46 in the shank 20 of the tool 22.

Figure 6:
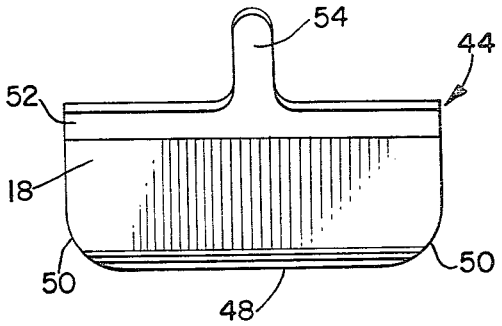
FIGS. 6, 7, and 8 are views of a component of the tool holder of FIG. 2.
Figure 8:
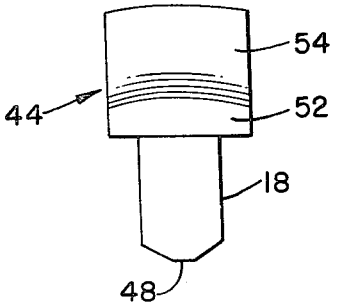
Figure 7:
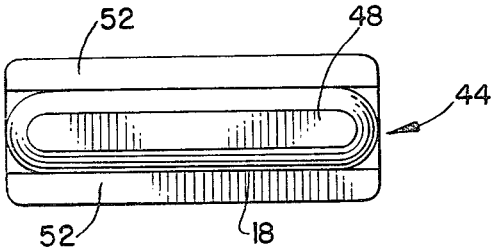

As shown in FIGS. 6, 7, and 8, each driving and retaining member 44 is in the form of a key and has a parallel-sided blade portion 18 whose inner face is rounded or shaped with flats as indicated at 48, the ends of the face also being radiused or chamfered as shown at 50. Shoulders 52 prevent the keys 44 passing through slots 24 and 25 in the drive sleeve 8 and thereby limit the inward movement of the keys 44. Centrally of its length, each key 44 is formed with a central protrusion 54. As can be seen from FIG. 8, the outer surface of the shoulders 52 is rounded. Also, the ends of the protrusions 54 are rounded, as can be seen in FIGS. 6 and 8.

Returning mainly to FIG. 2, the keys 44 are urged radially inwardly of the sleeve 8 by resilient means in the form of "gapped" circumferential spring 56 which totally encircles the sleeve 8, except for a gap 55, and has diametrically-opposed apertures 57 through which the protrusions 54 extend outwardly and are located thereby. The outer curved surface of the shoulders 52 conform to and are engaged by the inner surface of the spring 56 which is formed from a flat strip.

Located within the selector ring 42 and surrounding the cylindrical part of the stop member 30 is a spring carrier 58 whose apertured end wall 60 forms a bearing surface for one end of a helical spring 62 encircling the circumferential spring 56, and in engagement at its other end with a shoulder 64 on a locking collar 66. Although only one spring is shown in the drawings, it will be appreciated that several springs may be used, such springs being arranged coaxially. Alternatively, a spring of some other form than helical could be used. The outer face of end wall 60 of the spring carrier 58 is formed with the other part 67 of the detent mechanism mentioned above and cooperates with the elements 40 to index the mode change mechanism 28.

Figure 3:
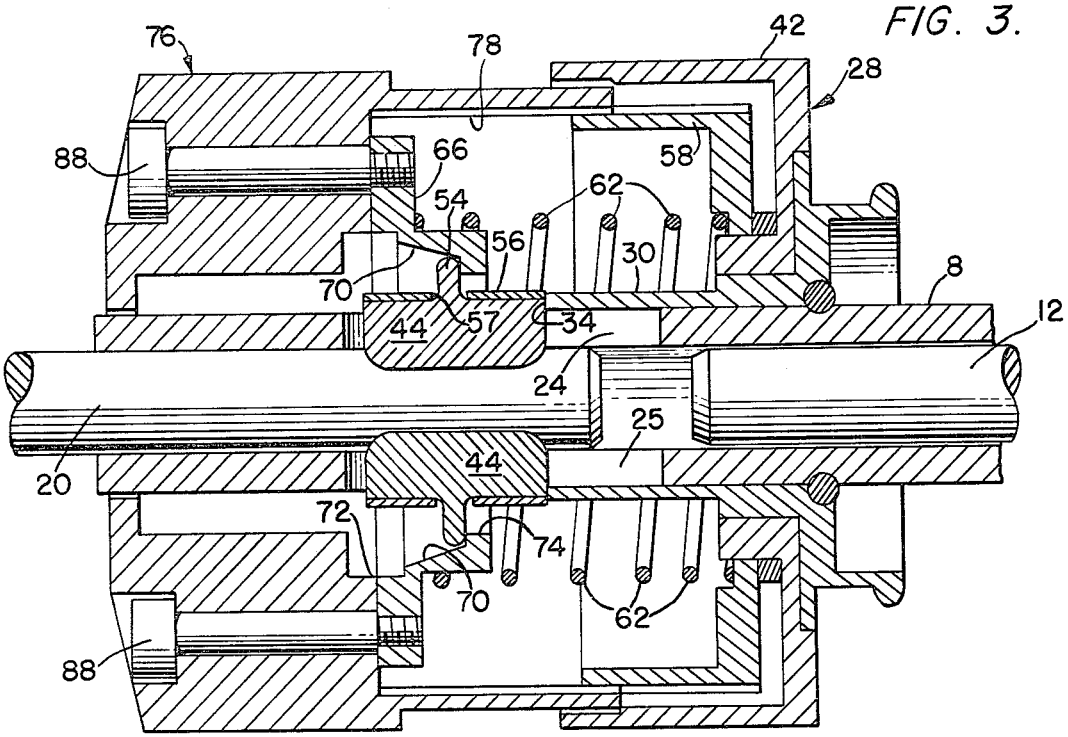
FIGS. 3, 4, and 5 are sections of the tool holder of FIG. 2 in different phases of operation.
Figure 4:
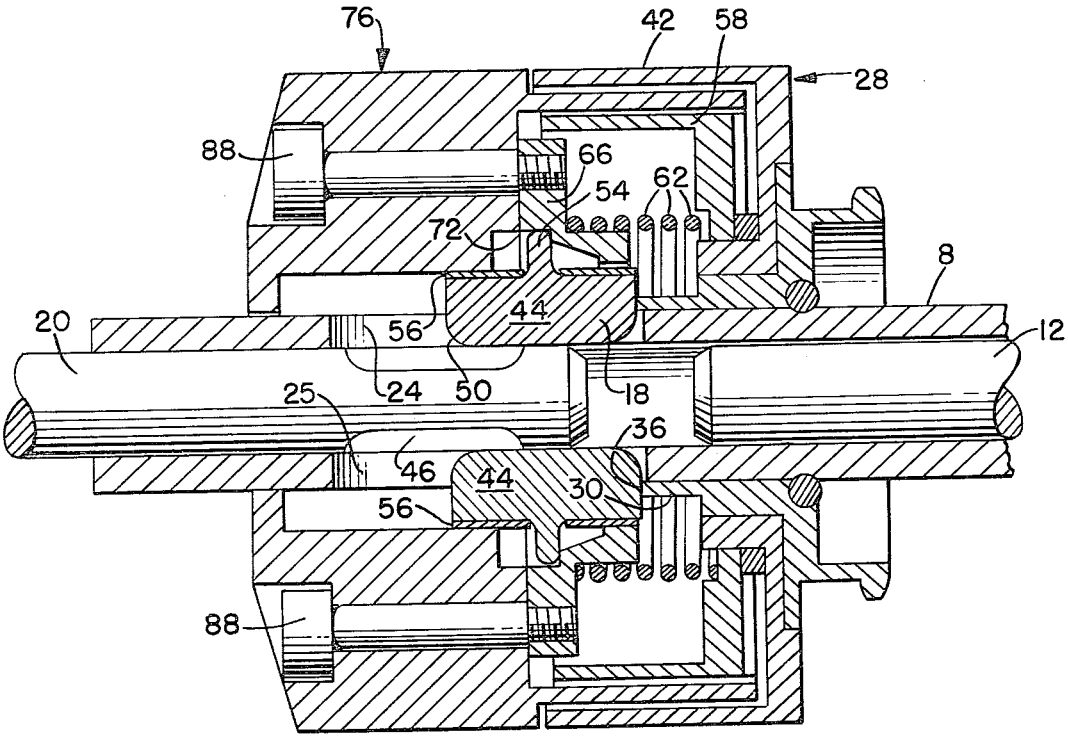
Figure 5:
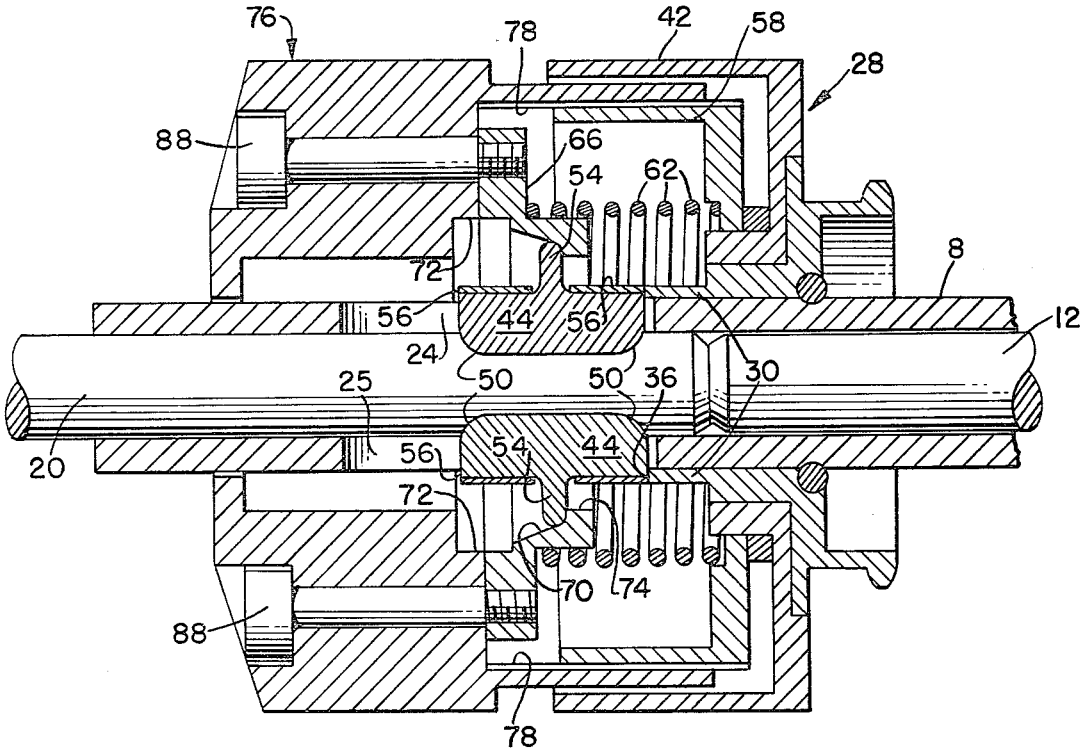

The collar 66 has an annular recess 68 whose internal surface diverges progressively outwardly over a portion 70 of its length in the axial direction (more clearly shown in FIGS. 3, 4, and 5). Instead of an annular recess, a local recess or recesses forming a keyway or keyways may be used. The portion 70 diverges outwardly towards another portion 72 of the recess 68 and whose depth as measured in a radially outward direction is greater than that of the divergent portion 70. The collar 66 has a bore 74 of a diameter such that the collar will not pass over the keys 44.

The forward end of the tool holder is housed within a cylindrical cover 76 into one end of which is telescoped the spring carrier 58. The internal curved surface of the cover 76 is formed with spline-like protrusions 78 which engage mating surfaces 80 on the spring carrier 58 to prevent rotation of the cover 76 relative to the spring carrier 58. Other ways of preventing such rotation may, of course, be used. The other end of the cover 76 has an end wall 82 with a central bore 84 therein and through which the sleeve 8 projects. The end wall 82 also has holes 86 through which extend screws 88 that secure the cover 76 to the locking collar 66. In this manner, the spring carrier 58 is held by the cover 76 and collar 66 against rotation with the selector ring 42.

The operation of the tool holder will now be described with reference mainly to FIGS. 3, 4, and 5.

To load a tool into the sleeve, the cover 76 is pushed back away from the tip or nose of the tool and assumes the position shown in FIG. 4 with the spring 62 compressed and with the collar 66 adjacent the end of the spring carrier 58.

With the cover 76 in the position shown in FIG. 4, the final axial position of the keys 44 in the slots 24, 25 will depend upon the orientation of the stop member 30. The keys 44 are moved along the slots 24, 25 towards the beat piece 12. In the position shown in FIG. 4, the stop member 30 is in a "hammer mode" position in which the stop member 30 has been rotated to a position in which the bottoms 36 of the slots 32 are axially aligned with the slots 24, 25, this orientation of the stop member 30 being shown in FIG. 2.

With the cover 76 in the position shown in FIG. 4, the user inserts the shank 20 of the tool 22 into the open end of the sleeve 8. The end of the shank comes into contact with the radiused ends 50 of the key 44 and forces them outwardly against the action of the circumferential spring 56. Such outward movement is possible because at this stage, the diametrically larger portion 72 of the annular recess 68 in the collar 66 is aligned with the protrusions 54 on the keys 44 and the portion 72 provides sufficient clearance for the outward movement.

As the movement of the shank 20 into the sleeve 8 continues, the keys 44 are able to return inwardly under the influence of the circumferential spring 56 and seat in the recesses 46 in the shank if these recesses are aligned with the blades 18 of the keys 44, otherwise the user simply rotates the tool until he feels the keys 44 seat in the recesses 46 under the action of the circumferential spring 56. The tool is then held in the sleeve and the cover 76 can be released.

The spring 62 now returns the cover 76, the collar 66 moving forwardly towards the tip of the tool and in so doing the protrusions 54 engage the divergent portion 70 of the collar 66, and thus the keys 44 are locked in engagement with the recesses 46. The keys 44 and the tool then move with the cover 76 and the collar to a position set by that end of the slots 24, 25 nearest the tip of the tool. This position is shown in FIG. 3. However, in FIG. 3 the stop member 30 is shown in a position for "non-hammer" mode as will be described later.

With the stop member 30 positioned as in FIG. 5, the user may now commence drilling, and when he places the tip of the tool against a work surface, the tool moves inwardly through the sleeve 8 to a position determined by the engagement of the keys 44 with the bottoms 36 of the slots 32. As shown in FIG. 5, this position is one that brings the inner end of the shank 20 into the range of movement of the beat piece 12 which when the rotary hammer is energised imparts a series of blows to the tool thereby producing the "hammer" effect thereon.

When the tip of the tool is removed from the work surface, the collar 66, keys 44 and the tool, under the influence of the spring 62, will resume the forward position with the keys abutting the ends of the slots 24, 25 nearest the tip of the tool similar to the position in FIG. 3. This takes the tool out of the operative range of the beat piece 12.

If the user wishes to change the mode of operation of the drill from the "hammer" mode to a "non-hammer" mode, i.e., rotation only, he is able to do this by rotating the selector ring 42, and thus the stop member 30, to bring the end faces 34 into alignment with the slots 24, 25. That position of the stop member is shown in FIG. 3, which also shows the keys 44 locked in engagement with the tool by the action of the surface 70.

With the stop member 30 in the FIG. 3 position, rearward movement of the tool and hence of the keys 44 is limited by the end faces 34, the tool is held out of operative engagement with the beat piece 12.

To remove a tool, the cover 76, is pushed rearwardly towards the selector ring 42, this action freeing the protrusions 54 from the divergent surface 70. Then the bit is withdrawn from the sleeve, the ends of the recesses 46 acting on the radiused ends 50 of the keys to push the keys outwards.

It will be appreciated that the contour of the inner surfaces 48 allows the keys 44 to mate closely with the corresponding surfaces of the recesses 46 and obtain adequate driving engagement with driving recesses 46 of different configurations. In addition, the axial length of the blade portion 18 is at most equal to that of the recesses 46. In this way, an adequate driving area is secured, even with bits having shallow recesses.

Furthermore, the action of the divergent surface portion 70 on the protrusions 54 to progressively engage them and progressively move the keys 44 inwards enables bits with shanks of different configurations to be accommodated. The action of the spring 62 on the collar 66 enables the divergent surface portion 70 to lock the keys 44 in position over a range of penetrations of the keys as is required by bits with recesses of differing depths. The locking action of the divergent surface portion 70 on the protrusions 54 resists rotation of the collar 66 relative to the keys 44 and so relative to the drive sleeve 8.

The axial length of the slots 24, 25 is equal to the axial length of the keys 44 plus the additional length necessary to allow axial movement of the tool during mode changing as described above. Axial movement of the keys 44 in the slots 24, 25 is facilitated by the parallel sides of the blade portions 18, and movement of the keys 44 is synchronised by engagement of the protrusions 54 in the apertures of the circumferential spring 56.

It will be appreciated that the spring 62 has three functions as follows:

(i) it moves the collar 66 when necessary to lock the keys 44 in an inward position, (ii) it assists and speeds movement of the tool into a non-hammer position when the tool is not pressed against a work surface, and, (iii) it loads the detent mechanism of the selector ring 28.

Figure 9:
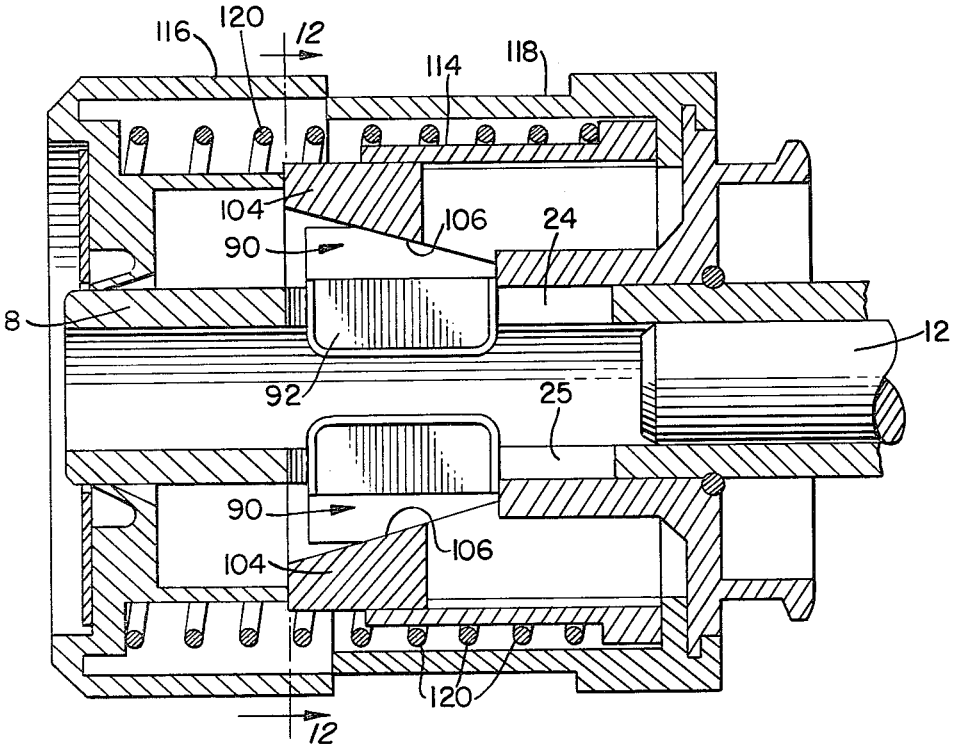
FIG. 9 is a section of another embodiment of a tool holder employing the present invention.

FIG. 9 shows a preferred later embodiment of the invention. It is similar in most respects and in operation to the embodiment described above in relation to FIGS. 1 through 8. The main differences concern the form of the retaining and driving keys, the form of the locking collar, and the absence of a circumferential spring.

Figure 10:
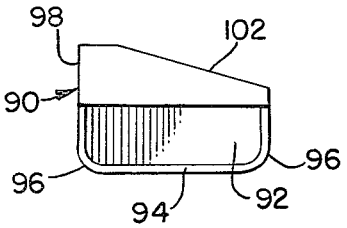
FIGS. 10 and 11 are views of a component of the tool holder of FIG. 9.
Figure 11:
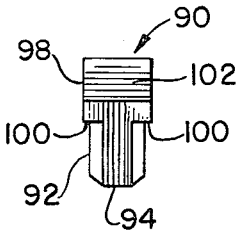

In FIGS. 10 and 11 each retaining and driving key 90 has a parallel sided blade portion 92. The blade 92 has a shaped inner face 94 as shown in FIG. 11. End faces of the blade 92 are similarly shaped. Corners 96 of the blade 92 between the inner face 94 and the end faces are radiused. The key has an enlarged outer part 98 with shoulders 100 formed between the part 98 and the blade 92, the shoulders being coplanar. These shoulders 100 function in the same way as those of the previously described keys 44 to limit inward movement of the keys 90. The outer surface of the part 98 is formed over most of its length by a flat surface 102 which is inclined at an angle of 15° to the plane of the shoulders 100. The part 98 combines the functions of the shoulders 52 and the protrusion 54 of the previously described key 44.

Figure 12:
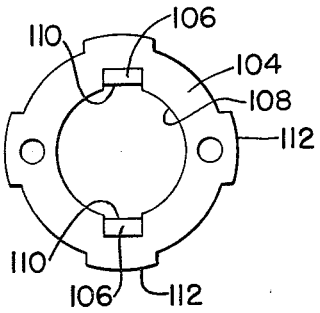
FIG. 12 is a view on the line 12—12 of FIG. 9 of another component.

FIG. 12 shows the locking collar 104 having a central bore 108 with two slots 110 communicating with the bore 108. The bottoms of the slots are formed by outwardly divergent flat surfaces 106 as more clearly seen in FIG. 9. The periphery of the collar 104 has four splines 112.

Referring now to FIG. 9, the tool holder has the same driving sleeve 8 as previously described, having two diametrically-opposed axial slots 24, 25 with a key 90 extending inwardly through each slot, the shoulders of the keys limiting inward movement. The previously described beat piece 12 is slidably housed in one end of the sleeve 8, the other end of the sleeve being ready to receive the shank of a tool. A spring carrier 114 has splines on its internal service which slidably cooperate with the splines 112 of the collar 104 to prevent relative rotation between the two parts. The forward end of the tool holder is housed within a cup shaped cover 116 which is telescopically slidable over the outer surface of a selector ring 118 which functions the same as the previously described selector ring 42. The cover 116 is securely attached by screws (not shown) to the collar 104. A coil spring 120 extends nearly the whole length of the tool holder and engages at its ends shoulders on the spring carrier 114 and cover 116 resiliently urging these two parts apart. The spring 120 is located on the outside of the carrier 114 adjacent the outer wall of the selector ring 118. The spring 120 functions the same as the previously described spring 62 and causes the collar 104 to engage the keys 90 urging them inwardly and to the ends of the axial slots 24, 25 nearest the end of the sleeve 8 through which the tool is inserted. However, the collar 104 acts upon each key 90 by the outwardly divergent surface 106 engaging the outwardly inclined surface 102 of the key. These two surfaces are flat, are inclined outwardly at the same angle, and stay in contact with each other. As each key 90 moves inwardly or outwardly with respect to the sleeve 8, the inclined surfaces 106 and 102 slide in contact with each other and progressively engage to a lesser or greater axial length, respectively. The engagement of the keys 90 in the collar slots 110, extending inwardly of the surfaces 106, prevents relative rotation between the collar 104 and the keys 90.

In both the foregoing embodiments, when in use, axial loads applied through the tool from the work surface are transmitted through the keys and by way of the stop surfaces 34, 36 through the stop member 30 to a suitable bearing surface of the rotary hammer, thereby determining the axial location of the stop member 30 on the sleeve 8. This may be achieved by a shoulder on the sleeve.

The above described embodiments, of course, are not to be construed as limiting the breadth of the present invention. Modifications, and other alternative constructions will be apparent which are within the spirit and scope of the invention as defined in the appended claims.

For example, the invention can also be applied to adaptors for rotary hammers. In this case the tool holder could have attached to or forming part of the drive sleeve a component which has a shank suitable for insertion into the chunk or tool holder of the rotary hammer. Further, in such an adaptor, if the keys are not required to undergo axial movement, then the axial length of the slots in the drive sleeve can approximate to that of the keys. The expression tool holder is used herein to include adaptors.

What is claimed is:

1. A tool holder, comprising:

a rotatable drive sleeve adapted to receive therein a tool and having a closed-ended slot disposed axially along part of its length;

a member having longitudinal side surfaces extending axially of said sleeve and extending inwardly into said slot, said member being movable through said slot for retaining and rotatably driving a tool when present, and having a part external of said sleeve for limiting inward movement of said member when the tool is absent;

a collar encircling said sleeve and movable axially in one direction for locking said member in engagement with the tool when present, and movable axially in the opposite direction to a position to allow disengagement of the tool;

a spring acting upon said member to urge resiliently inwardly said member to an inward position in the absence of the tool, and into contact with the tool when present including when said collar is in said tool disengagement position to facilitate correct engagement of the tool by said member upon insertion of the tool;

said slot having an axial length longer than that of said member and said member being axially movable along said slot;

a second spring resiliently urging said member to the end of said slot nearest the tip of the tool when present; and stop means, movable relative to said sleeve between two positions, for determining the effective length of said slot, whereby said slot has a shorter effective length and a longer effective length, respectively.

2. The tool holder recited in claim 1 wherein said sleeve has a second axially disposed closed-ended slot, and including a second member extending inwardly into said second slot and resiliently urged inwardly by said inwardly urging spring.

3. A tool holder, comprising:

a sleeve open at one end at least and adapted to receive a tool, said sleeve being rotatable about a central axis and having a wall with at least two closed-ended slots therein;

a key associated with each slot and having a shoulder portion and a protrusion, and being movable radially inwardly and outwardly in its respective slot with said shoulder portion limiting inward movement;

a locking collar encircling said sleeve and having an internal surface at least a portion of which diverges outwardly over at least a part of its length in an axial direction of said sleeve, and being axially movable relative to said sleeve, movement in one axial direction causing said surface portion to engage said protrusions and lock said keys in engagement with the tool when present, and movement in the opposite axial direction allowing said keys to move outwardly during entry and withdrawal of the tool into and from said sleeve;

stop means movable relative to said sleeve and having two stop surfaces displaced with respect to each other, movement of said stop means enabling one or the other of said stop surfaces to cooperate with said slot for determining its effective length, whereby said slot has a shorter effective length and a longer effective length, respectively; and a spring biasing said collar axially away from said stop means.

4. The tool holder recited in claim 3, further comprising a second spring in the form of a flat strip encircling said sleeve and having at least two apertures therein, said protrusions engaging said apertures to facilitate location of said keys, and said second spring urging said keys inwardly and yieldably allowing outward movement of said keys during entry and withdrawal of the tool.

5. The tool holder recited in claim 3 or 4, wherein said slots have an axial length greater than that of said keys and said keys are axially movable relative to said slots, said first spring urging said keys towards the end of said slots nearest the tip of the tool when present.

6. A tool holder for a rotary hammer, comprising:

a rotatable drive sleeve adapted to receive therein a tool and having a wall with a closed-ended slot therein;

a key having a blade portion slidable radially inwardly and outwardly in said slot, and a shoulder portion exterior to said slot for limiting inward movement of said blade portion, said blade portion having a length in the axial direction of said sleeve less than that of said slot and being slidable axially along said slot;

a collar encircling said sleeve and having an internal surface at least a portion of which diverges progressively outwardly in said axial direction, and being axially movable relative to said sleeve, movement in a first axial direction causing said surface portion to progressively engage said key and lock said key radially inwards in engagement with the tool when present, and movement in the opposite direction allowing said key to move outwardly during insertion and withdrawal of the tool into and from said sleeve;

a selector ring encircling said sleeve and having a stop member, and being rotatable about said sleeve, said stop member having two stop surfaces axially and radially displaced with respect to each other, rotation of said selector ring enabling one or the other of said stop surfaces to cooperate with said slot to determine its effective length, whereby said slot has a shorter effective length and a longer effective length, respectively; and a spring biasing said collar axially away from said stop member;

the arrangement being such that when the tool is present and said slot has said shorter effective length, said key is retained by said stop member at the end of said slot nearest the tip of the tool, and when said slot has said longer effective length said key slides axially along said slot to the opposite end upon the tip of the tool being pushed against a work surface, whereby the tool can be respectively disengaged from and engaged in a hammer mode of the rotary hammer.

7. The tool holder recited in claim 6, including a carrier member rotatably mounted on said stop member and having a first part of a detent mechanism, said carrier member being urged against said selector ring by said spring; and wherein said selector ring has a second part of said detent mechanism cooperative with said first part to releasably restrain said selector ring from rotation relative to said sleeve when either of said stop surfaces is in operative position.

8. The tool holder recited in claim 6 or 7, wherein said collar has a bore therethrough and an outwardly divergent slot in communication with said bore, said outwardly divergent slot having a bottom surface inclined outwardly in the axial direction away from said stop member, said bottom surface forming said surface portion; and wherein said key has an outer surface inclined outwardly in the same axial direction, said outer surface engaging in said outwardly divergent slot and slidably contacting said bottom surface.

9. A rotary hammer, comprising:

a motor;

a sleeve open at both ends and adapted to receive through one end a tool, and having at least one closed-ended slot disposed axially along part of its length;

transmission means operative between said motor and said sleeve for rotating said sleeve about its axis;

a beat piece reciprocally movable in said sleeve;

a key having a blade portion slidable radially inwardly and outwardly in said slot, said blade portion having a length in the axial direction of said sleeve less than that of said slot and being slidable axially along said slot;

a collar encircling said sleeve and having an internal surface at least a portion of which diverges progressively outwardly in an axial direction, and being axially movable relative to said sleeve, movement in one axial direction causing said surface portion to engage said key and lock said key radially inwardly in engagement with the tool when present, said surface portion enabling said key to penetrate inwardly different distances to accommodate tools having driving recesses therein of different depth, and movement in the opposite axial direction allowing said key to move outwardly during entry and withdrawal of the tool into and from said sleeve;

a selector ring encircling said sleeve and having a stop member and being rotatable about said sleeve, said stop member having two stop surfaces axially and radially displaced with respect to each other, rotation of said selector ring enabling one or other of said stop surfaces to cooperate with said slot to determine its effective length whereby said slot has a shorter effective length and a longer effective length, respectively; and a spring biasing said collar axially away from said stop member;

the axial relationship between said slot, said key, said stop surfaces, and said beat piece being such that when the tool is present and said slot has said shorter effective length, said key is retained by said stop member at the end of said slot nearest the tip of the tool to hold the tool out of engagement with said beat piece and place said rotary hammer in a non-hammer mode, and when said slot has said longer effective length said key slides axially along said slot to the opposite end, upon the tip of the tool being pushed against a work surface, to move the tool into engagement with said beat piece and place said rotary hammer in a hammer mode, and upon removal of the tool tip from the work surface said spring returns said key to said slot end nearest the tool tip so disengaging the tool from said beat piece.

10. The rotary hammer drill recited in claim 9, further comprising a second spring resiliently biasing said key inwardly to an inward position in the absence of the tool, and into contact with the tool during insertion of the tool into said sleeve.

11. A tool holder for a rotary hammer, comprising:

a rotatable drive sleeve adapted to receive therein a tool and having a closed-ended slot disposed axially along part of its length;

a member movable inwardly and outwardly in said slot and having a length in the axial direction of said sleeve less than that of said slot and being slidable axially along said slot;

stop means rotatable about said sleeve and having two stop surfaces axially and radially displaced with respect to each other, rotation of said stop means enabling one or the other of said stop surfaces to cooperate with said slot to determine its effective length, whereby said slot has a shorter effective length and a longer effective length, respectively; and a collar encircling said sleeve and movable relative to said sleeve for locking said member inwardly in engagement with said tool when present to retain said tool, and also movable to a position to allow disengagement of the tool;

the axial relationship between said slot, said member and said stop surfaces being such that when the tool is present and said slot has said shorter effective length, said member is retained by said stop means adjacent the end of said slot nearest the tip of the tool, and when said slot has said longer effective length said member slides along said slot to the opposite end upon the tip of the tool being pushed against a work surface, whereby the tool can be respectively disengaged from and engaged in a hammer mode of the rotary hammer.

12. The tool holder recited in claim 11, wherein said collar is axially movable relative to said sleeve, and including a spring resiliently urging said member away from said stop means.

13. The tool holder recited in claim 12, wherein said member has a blade portion engaged in said slot with parallel sides and an inner face, and a shoulder portion exterior to said slot for limiting inward movement of said member, the ends of said inner face being shaped to facilitate outward movement of said member during insertion and withdrawal of tools.

14. The tool holder recited in claim 13, wherein said stop means comprises a cylindrical part rotatably mounted on said sleeve and having a slot therein open at one end, said one stop surface being adjacent the open end of said open-ended slot and said other stop surface being at the closed end of said open-ended slot.

* * * * *